United States Patent [19]

Ooms et al.

[11] Patent Number: 4,927,695

[45] Date of Patent: May 22, 1990

[54] MICROPOROUS MARKING STRUCTURES

[75] Inventors: Willem Ooms; Frank R. Moss, both of Cookeville; Jonnie L. Key, Algood; Robert E. Ponter; David L. Hedgecoth, both of Cookeville, all of Tenn.

[73] Assignee: Porelon, Inc., Cookeville, Tenn.

[21] Appl. No.: 363,347

[22] Filed: Jun. 6, 1989

Related U.S. Application Data

[63] Continuation of Ser. No. 34,124, Apr. 2, 1987, abandoned, which is a continuation-in-part of Ser. No. 775,456, Sep. 11, 1985, abandoned.

[51] Int. Cl.[5] ..... B41K 1/38

[52] U.S. Cl. ..... 428/159; 101/333; 264/112; 428/315.5; 428/315.9; 428/321.3; 428/909

[58] Field of Search ..... 101/333; 264/112; 428/321.3, 159, 315.5, 315.9

[56] References Cited

U.S. PATENT DOCUMENTS 3,971,315 7/1976 Hansen ..... 428/321.3

4,306,498 12/1981 Fujimura ..... 428/321.3

*Primary Examiner*—William J. Van Balen

*Attorney, Agent, or Firm*—Foley & Lardner

[57] ABSTRACT

An improved microporous marking structure has a layer of a microporous material containing a marking fluid and an absorbent backing layer superposed thereon which shortens processing time by absorbing excess marking fluid from the microporous layer. The marking structure according to the invention may be advantageously used to make a self-linking hand stamp. No lengthy step for removing excess ink from the microporous layer is needed.

29 Claims, 1 Drawing Sheet

MICROPOROUS MARKING STRUCTURES

This is a continuation of Application Serial No. 034,124 filed 4/2/87, abandoned, which is a continuation-in-part of Ser. No. 775,456, filed 9/11/85, abandoned.

FIELD OF THE INVENTION

This invention relates to structures for applying marking fluids, including structures for use in marking devices, such as hand stamps and printing devices. The invention further relates to an improved method for preparing marking structures of the type containing their own essentially permanent supply of marking fluid, such that repetitive re-inking of the marking surface is unnecessary, and to marking structures made by such a method.

BACKGROUND OF THE INVENTION

Leeds U.S. Pat. Nos. 2,777,824 and 3,055,297 disclose marking structures made of highly porous plastic material, the pores of which are of microscopic proportions and are filled with a marking fluid such as an ink. Structures made in accordance with the teachings of the Leeds patents have experienced a high degree of commercial success as hand stamps, stamp pads, and also as ink rolls such as are used for applying ink to printing members in automatic printing equipment. Such structures are advantageous because of their long life, both in length of time and in numbers of operations or impressions, and because they operate well without the necessity of repetitive re-inking of the marking surface. Such structures apply ink in a uniform and reliable fashion. For example, hand stamps including plates made using such structures, which have various characters or designs molded at their surface, provide sharp and uniform impressions with high definition and uniformity. As stamp pads, such structures place a uniform layer of ink on a marking device, such as a rubber stamp, and are reliable over long periods of time. Similarly, as ink rolls, such structures provide uniform inking of printing members and exhibit fast recovery to facilitate repetitive use over long periods of time.

One problem with the method of making the marking structures disclosed in Leeds U.S. Pat. Nos. 2,777,824 and 3,055,297, is the time required to produce these structures. For example, in the case of hand stamps, the total processing time may be a period on the order of about 15 hours. A lengthy period of time is primarily required for a "curing" step, in which the molded structure reaches an initial dimensional stability and excess ink flow from the structure is stabilized. The present invention reduces the processing time to about two hours for a typical hand stamp, primarily because no lengthy "curing" step is necessary.

An additional concern with the marking structures made using the disclosures of Leeds is that the process is complex and requires skilled workers to produce acceptable marking devices. This leads manufacturers of these devices to centralize their manufacture. This is a problem for hand stamps which are custom made to order. Because of the time required, the prior process could not prepare stamps on a "while you wait" basis but required a one to two day wait.

Known methods of making marking structures generally involve an initial step of making a mold having indentations or cavities corresponding to a relief pattern to appear on the finished marking structure. The mold is made of a material which can partially absorb marking fluid from the finished marking structure. Since it is necessary to use an excess amount of marking fluid in order to make the marking structure, it is necessary to make the mold from an absorbent material to remove the excess ink from the marking structure as it cures in the mold.

A premix containing a thermoplastic resin and a marking fluid, such as an ink, is then placed in the mold to fill the indentations and form a layer of premix therein. The resulting premix-filled mold is then placed in a press, and subjected to heat and pressure sufficient to form the ink-impregnated microporous structure which is suitable for making a self-inking (self-replenishing) hand stamp. The open-celled, skinless nature of the microporous structure allows a small but generally constant flow of ink from the marking structure. Thus, as ink is removed from the surface of the relief pattern on the marking structure when an impression is made, ink from the interior of the marking structure flows to the surface in sufficient quantity to allow formation of further images having substantially the same brightness and clarity as the initial image.

In the foregoing known method, it is important to avoid using an non-absorbent mold or matrix board. Under the heat and pressure used in the step of making the microporous structure, a non-absorbent mold would ruin the marking structure. The present invention provides a method for making microporous marking structures which eliminates some of the disadvantages of this known method.

SUMMARY OF THE INVENTION

The marking structure of this invention includes an outer layer which is used to apply a marking fluid, such as ink, for the intended purpose, and an absorbent backing layer underlying the outer layer for absorbing excess ink therefrom. The outer layer comprises, according to one aspect of the invention, a microporous material formed of interconnected aggregated particles of a thermoplastic resin impregnated with the marking fluid. The interconnected aggregates form a substantially uniform, unitary cohesive structure which defines a corresponding network of pores. The network of pores contains the marking fluid, e.g. an ink, which is substantially incompatible with (nonsolvent to) the resin.

The method of the present invention comprises placing a premix capable of forming a microporous structure containing a marking fluid in a mold, placing an absorbent backing layer on the premix, heating the premix to form a microporous structure therefrom, and cooling the microporous structure. The backing layer absorbs excess marking fluid from the microporous structure so that no lengthy curing or "blotting" step is needed.

According to a further aspect of the invention, the premix contains a thermoplastic resin and an ink which does not dissolve the resin, and the backing layer partially absorbs the premix (both resin and ink) to form an interface zone which unites the microporous ink-impregnated layer to the backing.

BRIEF DESCRIPTION OF THE DRAWING

The invention will be further described with reference to the appended drawing, wherein like numerals denote like elements, and.

DETAILED DESCRIPTION OF PREFERRED EMBODIMENTS

The present invention advantageously utilizes an ink-impregnated microporous marking structure as part of a hand stamp. As used herein, the term "microporous" means having an open-celled network of small interstices or voids both at the surface of a piece of material and throughout the interior thereof, i.e. remote from its surface. The material has pores small enough to prevent substantial bleed-out (leakage) of a marking fluid, i.e. small enough as to be not normally discernible by the naked eye, yet large enough to permit some flow therein of a marking fluid such as an ink as described hereinafter. For example, a material having an average pore size of less than about 100 microns in diameter and greater than about 0.5 microns in diameter functions well in this invention, although any properly selected pore size or distribution relative to the viscosity and ability of the fluid to wet the material may be suitably selected by those skilled in the art.

The micropores of the material described herein with particular reference to the exemplified embodiment are not necessarily either symmetrical or similar to each other in shape and size. Indeed, such pores are oftentimes otherwise quite irregular and varied in shape and size, and for this reason it may be difficult to determine the "diameter" of any given pore or the "average diameter" of pores of a particular material. Thus, average pore size as used herein generally refers to the average of the largest dimension of each such irregular pore.

Figure 1:
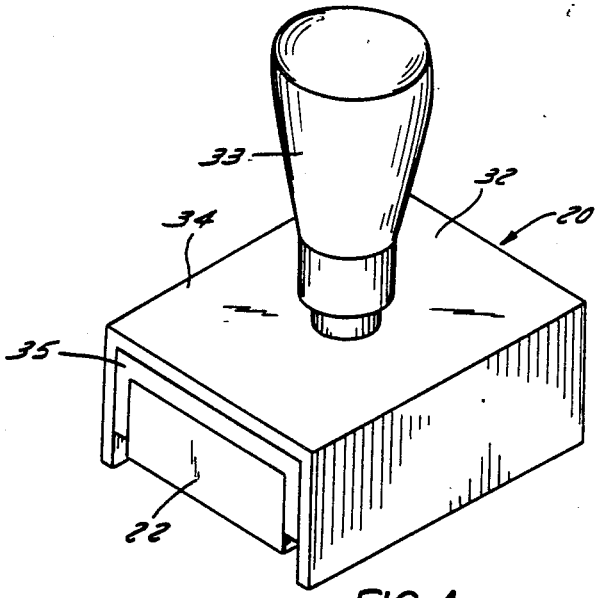
FIG. 1 is a perspective view of a hand stamp having a marking structure of this invention.
Figure 2:
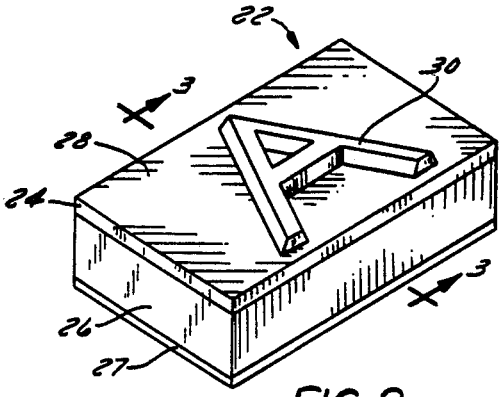
FIG. 2 is an inverted perspective view of the marking structure portion of FIG. 1.

FIG. 1 illustrates a hand stamp 20 having a marking structure 22 according to this invention. As shown in FIG. 2, marking structure 22 is a block structure having three successive layers including an outer, ink-impregnated, microporous layer 24, an absorbent backing layer 26 and a sealant layer 27. Ink-impregnated layer 24 contains an ink which is applied, through a relief portion 30 (e.g. characters) to a marking surface such as a piece of paper. Marking structure 22 is attached to a hand stamp mount 32.

Hand stamp mount 32 generally includes a plastic elongated handle 33 oriented perpendicularly to the imaginary plane defined by the surface of relief portion 30 of ink-impregnated layer 24, which handle 33 is slidably interlocked with an outer, generally trough-shaped or rectilinear frame 34 which covers at least the top and sides of marking structure 22. Handle 33 is secured for unison movement with an inner, generally trough-shaped or rectilinear frame 35 of smaller dimensions than outer frame 34. Sealant layer 27 of marking structure 22 is secured by suitable means, such as a layer of adhesive, directly to the inner surface of inner frame 35. Sealant layer 27 provides a surface for the adhesive to bind to and prevents absorbed ink from penetrating to the adhesive, possibly causing marking structure 22 to become separated from mount 32. One suitable sealant is a plastisol of polyvinyl chloride in methyl ethyl ketone. In the prior art, such a sealant layer was applied directly to the rear face of the microporous structure and that approach may successfully be adopted here.

Handle 33, inner frame 35 and marking structure 22 are generally biased by suitable resilient means, e.g. a spring (not shown), to an upward position so that hand stamp 20 may rest on a table top or similar surface with marking structure 20 in a raised, non-printing position. The user grasps hand stamp 20 by handle 33, positions it over a surface to be marked and presses down to print an image. Outer frame 34 allows the user to brace the stamp against the surface to be marked. Absorbent layer 26 does not impair the functioning of the finished hand stamp.

Figure 3:
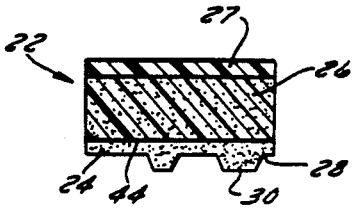
FIG. 3 is a sectional view of the marking structure of FIG. 2, taken along the line 3—3 as indicated in FIG. 2.

FIG. 3 shows a cross-section of marking structure 22. Ink-impregnated layer 24 has a front surface 28 and relief portion (character) 30 which is integrally connected with, and made of the same material as, surface 28. Ink-impregnated layer 24 is connected to backing layer 26 at an interface zone 44. Although the interface is shown as a sharp line of demarcation, the interface actually is a zone along the lower portion of backing layer 26. During the process of the present invention, as will be discussed below, a portion of ink-impregnated layer 24, including both resin and ink, may be absorbed into backing layer 26 to form interface zone 44. This preferred implementation bonds outer layer 24 and backing layer 26 together and allows excess ink from layer 24 to flow into backing layer 26 during the short stabilization period rather than out of surface 28. Unless backing layer 26 is bonded to ink-impregnated layer 24, the resulting laminate may not hold together during subsequent processing and, thus, this approach improves manufacturing integrity.

According to a preferred embodiment of the invention, marking structure 22 may be prepared as follows. A thermoplastic resin powder, such as polyvinyl chloride powder, which will pass through a 75 mesh screen, is blended with a plasticizer, such as liquid dioctyl phthalate, forming a plastisol blend. A marking fluid such as ink, separately prepared from dyes, pigments, dye solvents and vehicles which are substantially incompatible with the resin, is added to the plastisol blend, preferably in a weight ratio of marking fluid to plastisol blend within the range of about 0.1–1.0. The resulting mixture is referred to as the "premix."

The intended end use and quality of the marking structure of this invention will tend to determine the needed amount of marking fluid. If the ink-plastisol ratio is below about 0.1, there will be little or no application of marking fluid on the surface of intended application. Above a ratio of 1.0 the strength and structural integrity of the outer layer are lessened (perhaps catastrophically depending upon the exact ratio and composition of components) and there may be a tendency to "bleed out" marking fluid even when the marking structure is not being used. If a very light impression or disposition of marking fluid is intended, the ratio of marking fluid to thermoplastic resin can be fairly low. On the other hand, if a heavy impression or deposition of marking fluid is intended, the ratio of marking fluid to thermoplastic resin should be fairly high. A preferred range for the ratio of ink to thermoplastic resin for the ink-impregnated layer is in the range of about 0.3–0.7. Within this range, a strong impression may be applied and strength of the material is good.

Materials suitable for forming the backing layer 26 include wool (woven or felted), cotton (woven or felted), urethane foam, polyvinyl chloride (PVC) foam, jute, hemp, cork, non-woven cellulose (including paper and cardboard), and fabrics of treated synthetic fibers (woven or non-woven) such as polyethylene, polypropylene, nylon, rayon, polyester, teflon, and fiberglass. Suitable urethane foams must be of the open cell type with interconnected pores to allow for fluid transfer.

Backing layer 26 is preferably a felt treated with a sizing material which enhances absorption of the premix. The felt is preferably at least 75%, preferably 95% wool. Wool absorbs the premix in a superior fashion. The felt should have a density within the range of from about 12 to 20 pounds per square yard for felts having a nominal thickness of one inch, hereafter referred to as "nominal square yard." Suitable felts include wool felt covered by ASTM standard specification D2475-77, and particularly those classified 12R, 16R, 16S, 18R and 20S. The preferred felt has a density of 14 to 18 pounds per nominal square yard.

The felt is preferably impregnated with the sizing material. Sizing materials which are compatible and absorb sufficient premix include the starches such as wheat starch, corn starch and the like. The preferred sizing material is wheat starch. The sizing material is advantageously present in an amount of from 4 to 12% by weight, most preferably from 4 to 8% by weight. At amounts of less than 4%, the backing material is not sufficiently rigid to keep the surface 28 below 4%, the stamp will begin to curl on aging. At amounts of sizing material greater than 12%, the absorbency of the backing layer 26 for the premix is lowered such that additional periods of stabilization are required.

Backing layer 26 preferably has a thickness at least about equal to the thickness of ink-impregnated layer 24. Preferred thicknesses range. from 0.075 to 0.335 inches. The preferred thickness for use in hand stamps is 0.1 to 0.15 inches. The thickness of the backing material, in general, is preferably sufficient to absorb at least 0.30 to 0.70 grams of marking fluid per square inch of back layer, particularly 0.40 to 0.50 gm/in$^2$. Excessive absorption will shorten stamp life, while insufficient absorption can cause ink leakage.

A mold in the size and shape of the desired marking structure, having the desired design (e.g. characters) engraved in its surface, is used to form the marking structure. The premix is poured into this mold to a total depth approximately twice the thickness of the mold cavities used for forming characters. The backing layer is then placed in the mold on top of the premix. A cover plate is tightly secured to the mold to enclose the materials in a sealed, restricted space. The mold is preferably nonabsorbent to the premix, i.e. does not absorb any marking fluid or resin. Molds made of impermeable phenol-formaldehyde resin are suitable for this purpose. A mold having an array of different messages or designs thereon for forming multiple hand stamps, called a matrix board, is conveniently used to improve productivity.

The mold or matrix board is then heated to a high temperature, normally within the range of about 110°-150° C. for a sufficient period to form the microporous layer (plate), normally about 5-50 minutes, depending primarily upon the size and shape of the marking structure being produced and the type of thermoplastic resin being used. During this molding process, the premix used to form the outer, ink-impregnated layer is partly absorbed into the backing layer to form the interface zone 44 of the two layers. The aggregates of the ink-impregnated layer define a network of pores which is partially filled with the ink. As the premix is heated, it is preferably subjected to uniform pressure of at least about 0.5 ton for not less than about 5 minutes, preferably at least 10 minutes. The pressure aids formation of the microporous structure and enhances bonding of the backing and microporous structure.

The backing layer absorbs excess ink from the ink-impregnated layer and allows molding to be carried out on a non-absorbent mold. The molds currently used industry wide must have some absorbency to accomodate the excess marking fluid that is present during molding. Normally, if the mold has too little or too much absorbency, as determined by the-particular formula of premix being used, the finished marking structure can be affected adversely, i.e. either has too much marking fluid left in it to be removed after molding, or has too little marking fluid and correspondingly reduced performance. The backing layer eliminates problems encountered in practice with molds having inadequate ink absorption properties.

The marking structure is cooled to room temperature within the sealed mold, either by placing such sealed mold in an environment cooled below room temperature, such as by circulating cold fluids around the mold, or simply by allowing the mold to stand at room temperature for a period of time. The marking structure is then removed from the mold and is ready for mounting to a suitable holder such as hand stamp mount 32 shown in FIG. 1. The marking structure is then ready for use. The described process eliminates the need for a lengthy waiting period, e.g. a step wherein excess ink slowly leaks from the ink-impregnated layer.

A wide variety of thermoplastic resins, particularly synthetic resins, are acceptable for use in the marking structure of this invention. Resins which fuse at a temperature below the boiling point of the marking fluid which is used therewith should be used. Examples of acceptable thermoplastic resins are: polyvinyl chloride, polyvinyl acetate, polyvinylidene chloride, polyvinyl butyral, cellulose acetate butyrate, polymethyl methacrylate, polymethyl acrylate, polysulfone and copolymers and combinations thereof. Highly preferred resins include: polyvinyl chloride, polyvinyl acetate, polyvinylidene chloride, polyvinyl acetate, polyvinylidene chloride, copolymers of vinyl chloride and other ethylenically unsaturated monomers, and combinations thereof. The most preferred resins are copolymers of vinyl chloride and vinyl acetate.

A plasticizer is used in the premix in an amount of about 40 to 160 percent by weight of the resin. The plasticizer should soften the resin to allow the formation of aggregates which form the marking structures of the invention. Examples of suitable plasticizers for use with polyvinyl chloride, polyvinyl acetate, polyvinylidene chloride, copolymers of vinyl chloride and other ethylenically unsaturated monomers, or combinations thereof, include tricresylphosphate, dioctyl phthalate, dimethyl phthalate, dibutyl phthalate, butyl benzyl phthalate, trioctyl phosphate. Other acceptable plasticizers for use with specific thermoplastic resins are well-known. The aforementioned Leeds patents list plasticizers useful with a wide variety of thermoplastic resins, many of which are suitable for use in this invention. The contents of Leeds U.S. Pat. Nos. 2,777,824 and 3,055,297 are expressly incorporated by reference herein. The use of plasticizers facilitates the formation of interconnected aggregates of thermoplastic resin. The aggregates of thermoplastic resin are sintered, that is, joined by heat, to form a cohesive structure.

The marking fluid used in this invention, in addition to-being suitable for the intended purpose, must be incompatible with (nonsolvent to) the thermoplastic resin used in the sense that such fluids must not substantially soften or dissolve such resins. An extremely wide variety of known marking fluids are acceptable. Inks are normally prepared from dyes, pigments, and dye solvents and vehicles. Such solvents and vehicles must not readily dissolve the resins. Examples include: aliphatic hydrocarbons, castor oil esters, ethanolamides, fatty acids, fatty acid esters, glyceryl esters, glycols, glycol esters, marine oils, mineral oils, polyethylene and polypropylene glycols, and vegetable oils. Dyes are generally used in such inks in amounts of from about 5–25 percent of total ink weight. The dyes, of course, must be soluble in the dye solvent used. Color pigments are normally dispersed in the vehicles used in amount of from about 2–20 percent of total ink weight. Particle sizes of the pigments must be small enough to pass through the micropores of the marking structure.

Suitable marking fluids and methods for preparing such fluids are known in the art, and form no part of this invention. The term "marking fluid" refers to inks of various kinds and also to other fluids which can be applied in like manner, that is]by contact of the microporous layer with the surface of intended application.

EXAMPLE 1

A premix is prepared according to procedures generally known in the art. First, a preblend of materials is prepared by adding 283.5 pounds of linoleic acid to a container and heating to 175° to 185° F., followed by adding 141.5 pounds of ester gum from CDI Dispersions. The mixture is agitated with heating to 200° to 210° F. The preblend is then cooled to 150° F. for use.

A mixing vessel is charged with 26.1 pounds of a 75% solution of 2,4,7,9-tetramethyl-5-decyne-4,7-diol in 25% ethylene glycol, 26.1 pounds of dioctyl phthalate, 87 pounds of butyl benzyl phthalate, 43.5 pounds of a copolymer of vinyl chloride and vinyl acetate and 217.5 pounds of a copolymer of vinyl chloride and vinyl acetate. A vacuum of 27 inches of mercury is applied to the mixture, and it is agitated for 25 minutes at low speed. At this point, 52.5 pounds of dioctyl phthalate is added along with 17.4 pounds of Interstab BC-103 (a mixture containing about 18% of nonaromatic hydrocarbon solvent, about 5% of an aromatic hydrocarbon solvent, a barium monocarboxylic acid salt containing less than such that the composition as a whole contains less than 10% barium a zinc monocarboxylic acid salt such that the composition as a whole contains less than 1% zinc, and a cadmium salt of monocarboxylic acid such that the composition as a whole contains less than 5% cadmium), 6% mixed glycol ethers, 25% alkyl aryl phosphite and 7% alcohol, together with 139.2 pounds of the preblend prepared above. The resulting mixture is mixed under vacuum for 10 minutes. At this time 261 pounds of a blue ink is added and the mixture is agitated under vacuum.

The resulting premix is used as follows to make hand stamps. A negative matrix board having a desired relief pattern is prepared using known methods such as the hot lead technique or photopolymer pattern plates. The matrix board is then placed into a 4"×6" mold. The premix is carefully stirred and then about 12 g of premix is applied over the matrix board. The premix is out air and eliminate pin holes. The mold is then filled with an additional 30 g of premix to a total fill of about 42 g. A piece of ⅛" 16R1 felt impregnated with 6% wheat starch sizing, as a backing layer, is placed over the premix within the mold. The top of the mold is then placed over the absorbent backing layer and the entire mold is placed into a press which has been preheated to 125° C. The press is then closed and a force of 5 tons is applied for 15 minutes. At the end of the above time, the pressure is released and the mold is removed from the press and allowed to cool to room temperature. The mold is disassembled and the casting is peeled away from the plate. The casting is then cut into individual pieces for use as hand stamps and applied to conventional hand stamp mounts using an appropriate adhesive. It is preferred to seal the back of the backing layer with suitable sealers such as EC821 available from 3M Company, so that the plastic of the hand stamp frame may be bonded securely to the surface of the backing layer, and ink absorbed by the backing layer cannot contact the adhesive used to bond the hand stamp mount to the marking structure.

EXAMPLE 2

A premix is used to prepare hand stamps using the procedure as set forth in Example 1, with the exception that the backing layer is urethane foam of an open cell design. The foam is ⅛ thick and of a density of 4 to 1, i.e. normally produced urethane foam is compressed by standard industry methods from a free or ambient condition to ¼ its thickness. Examples include designations of 4-900z, 4-800z, 5-600z.

It will be understood that the above description is of preferred exemplary embodiments of the invention, and that the invention is not limited to the specific forms shown.

It will be understood that the term "layer" as used herein does not necessarily mean the layer in question has a planar shape or that such layer completely covers or is completely covered by adjoining layers. The present invention does not preclude the use of an intervening layer between the marking-fluid impregnated layer and the absorbent backing, so long as the absorbent backing is able to absorb excess marking fluid. Modifications may be made in the described methods and products without departing from the scope of the invention as expressed in the appended claims.

We claim:

1. In a self-replenishing marking structure including a marking fluid impregnated plate having a front relief surface for transferring a marking fluid image to a surface to be marked, the improvement comprising:

a marking-fluid absorbent backing layer disposed on said plate for absorption of excess marking fluid therefrom, said backing layer comprising a fabric impregnated with an amount of a sizing agent effective for preventing curling of said fabric after said fabric is bonded to said plate.

2. A hand stamp, comprising;

a mount;

a marking structure including a ink-impregnated layer having a microporous structure containing an ink, said ink-impregnated layer having a relief pattern on a front face thereof for transferring an ink image of said relief pattern to a surface to be marked, an absorbent backing layer bonded to said ink-impregnated layer comprising a felt impregnated with an amount of a sizing agent effective for preventing curling of said felt after said felt is bonded to said ink-impregnated layer, said felt containing excess ink absorbed from said ink-impregnated layer, and an ink-impermeable sealant layer covering a rear face of said backing layer; and means for securing said marking structure to said mount.

3. The hand stamp of claim 2, wherein said mount comprises an elongated handle and a frame connected to said handle and secured by said securing means to an outer surface of said sealant layer of said marking structure.

4. The hand stamp of claim 3, wherein said securing means comprises a layer of adhesive.

5. The hand stamp of claim 4, wherein the resin is selected from the group consisting of polyvinyl chloride, polyvinyl acetate, polyvinylidene chloride, copolymers of vinyl choloride and other ethylenically unsaturated monomers, and combinations thereof.

6. The hand stamp of claim 5, wherein the resin is a copolymer of vinyl chloride and vinyl acetate.

7. A marking structure, comprising:

a microporous layer having front and rear faces and formed from interconnected particles of a thermoplastic resin impregnated with an ink, said microporous layer having a relief pattern on a front fact thereof for transferring an ink image of said relief pattern to a surface to be marked, said particles forming an open-celled network of pores allowing repetitive transfer of an ink image of said relief pattern to the marking surface; and an absorbent backing layer having front and rear faces, said front face of said backing layer being superposed on said rear face of said ink impregnated layer, said backing layer containing excess ink absorbed from said ink impregnated layer in an amount in the range of about 0.3 to 0.7 grams of ink per per square inch of said backing layer, and said backing layer is bonded to said microporous layer at an interface zone wherein said resin permeates said backing layer.

8. The marking structure of claim 7, wherein said backing layer has a thickness in the range of about 0.075 to 0.335 inch.

9. The marking structure of claim 8, wherein said backing layer has a thickness in the range of about 0.1 to 0.15 inch, and said backing material contains about 0.4 to 0.5 grams per square inch of said ink.

10. The marking structure of claim 7, wherein said backing layer has a thickness in the range of about 0.1 to 0.15 inch.

11. The marking structure of claim 7, wherein said backing layer is made of a material selected from the group consisting of wool, cotton, nonwoven cellulose, synthetic fibers, and combinations thereof, and said resin is selected from the group consisting of polyvinyl chloride, polyvinyl acetate, polyvinylidene chloride, copolymers of vinyl choloride and other ethylenically unsaturated monomers, and combinations thereof.

12. The marking structure of claim 7, further comprising a ink impermeable sealant layer covering said rear face of said backing layer.

13. The marking structure of claim 7, wherein said resin is a copolymer of vinyl chloride and vinyl acetate, said felt is at least 75% by weight wool and has a density in the range of from about 12 to about 20 pounds per nominal square yard.

14. The marking structure of claim 7, wherein said interface zone is formed by placing said backing layer on a fluid premix material containing said resin and said ink, allowing said resin and said ink to permeate into said backing layer, and then heating said premix sufficiently to form said microporous layer and bond said backing to said microporous layer at said interface zone.

15. A marking structure for repetitive transfer of an ink image of a relief pattern to a marking surface, which marking structure is substantially free of ink leakage following formation of said marking structure, wherein said marking structure is made by the steps of:

placing a premix comprising a thermoplastic resin and an ink in a mold having cavities defining a pattern so that said premix fills said cavities and excess premix forms a continuous layer over said cavities;

then placing a layer of an ink-absorbent backing material on said layer of premix under conditions effective to cause said resin and said ink to permeate into said backing material to form an interface zone at a front face of said backing material in which said backing material contains said premix;

then heating said premix to form a solid, microporous, open-celled, ink-impregnated structure having a relief pattern corresponding to said cavities, and to bond said microporous structure to said backing at said interface zone to form a marking structure; and then cooling said marking structure;

wherein said backing layer absorbs excess ink from said microporous layer which would otherwise leak from the front face of said marking structure.

16. The marking structure of claim 15, wherein said marking structure is a hand stamp made by the additional steps of:

removing said marking structure from said mold, and mounting said marking structure to a hand stamp mount to form said hand stamp.

17. A method for preparing a marking structure for repetitive transfer of an ink image of a relief pattern to a marking surface, which marking structure is substantially free of ink leakage following formation of said marking structure, comprising the steps of:

placing a premix comprising a thermoplastic resin and an ink in a mold having cavities defining a pattern so that said premix fills said cavities and excess premix forms a continuous layer over said cavities;

then placing a layer of an ink-absorbent backing material on said layer of premix under conditions effective to cause said resin and said ink to permeate into said backing material to form an interface zone at a front face of said backing material in which said backing material contains said premix;

then heating said premix to form a solid, microporous, open-celled, ink-impregnated structure having a relief pattern corresponding to said cavities, and to bond said microporous structure to said backing at said interface zone to form a marking structure; and then cooling said marking structure;

wherein said backing layer absorbs excess ink from said microporous layer which would otherwise leak from the front face of said marking structure.

18. The method of claim 17, wherein said mold is substantially non-absorbent to said ink.

19. The method of claim 17, wherein said premix is a mixture of said ink and a plastisol comprising a powder of said thermoplastic resin and a plasticizer, wherein the weight ratio of ink to plastisol is in the range of about 0.1 to 1.

20. The method of claim 19, wherein said plasticizer is selected from the group consisting of tricresylphosphate, dioctyl phthalate, dimethyl phthalate, dibutyl phthalate, butyl benzyl phthalate, and trioctyl phosphate.

21. The method of claim 18, wherein said mold is made of a phenol-formaldehyde resin.

22. The method of claim 17, wherein said premix is heated to a temperature in the range of about 110° C. to 150° C. for at least about 5 minutes.

23. A method for making a hand stamp, comprising:

placing a premix comprising a thermoplastic resin and an ink in a mold having cavities defining a pattern so that said premix fills said cavities and excess premix forms a continuous layer over said cavities, said mold being substantially non-absorbent to said ink;

then placing a layer of an ink-absorbent backing material on said layer of premix under conditions effective to cause said resin and said ink to permeate into said backing material to form an interface zone at one face of said backing material in which said backing contains said premix;

then heating said premix to form a solid, microporous, ink-impregnated structure having a relief pattern corresponding to said cavities, and to bond said microporous structure to said backing at said interface zone to form said marking structure;

then cooling said marking structure;

then removing said marking structure from said mold; and then securing said marking structure to a handle with a layer of adhesive to form a hand stamp, wherein said backing layer absorbs excess ink from said microporous layer which would otherwise leak from the front face of said hand stamp.

24. The method of claim 17, wherein said resin is selected from the group consisting of polyvinyl chloride, polyvinyl acetate, polyvinylidene chloride, copolymers of vinyl choloride and other ethylenically unsaturated monomers, and combinations thereof.

25. The method of claim 24, wherein said backing material is selected from the group consisting of wool, cotton, urethane foam, polyvinyl chloride foam, jute, hemp, cork, nonwoven cellulose, synthetic fibers, and combinations thereof.

26. The method of claim 17, further comprising a step of coating a rear face of said backing layer with a fluid sealant which sets to form a sealant layer thereon.

27. The method of claim 17, further comprising, during said heating step, pressing said backing layer and said premix together in said mold.

28. The method of claim 27, wherein said heating step further comprises placing said mold in a preheated press, which press applies a pressure of at least about 0.5 ton on said premix and said backing layer.

29. The method of claim 28, wherein said step of heating said premix and pressing said premix and said backing layer continues for at least about ten minutes in a mold which is non-absorbent to said ink.

* * * * *